United States Patent [19]

Ijäs

[11] 4,280,567

[45] Jul. 28, 1981

[54] DEVICE FOR DRIVING ROOT SUPPORTS OF POLES INTO THE GROUND

[75] Inventor: Seppo Ijäs, Ulvila, Finland

[73] Assignee: Oy Ensio Miettinen AB, Porvoo, Finland

[21] Appl. No.: 49,051

[22] Filed: Jun. 15, 1979

[30] Foreign Application Priority Data

Jun. 28, 1978 [FI] Finland ..... 782050

[51] Int. Cl.[3] ..... E04H 12/34

[52] U.S. Cl. ..... 173/129

[58] Field of Search ..... 173/90, 128, 129, 132, 173/86; 52/170

[56] References Cited

U.S. PATENT DOCUMENTS

| | | | |
|---|---|---|---|
| 2,833,120 | 5/1958 | Bannett et al. | 173/128 X |
| 3,001,515 | 9/1961 | Haage | 173/128 |
| 3,320,714 | 5/1967 | Barrett | 52/170 X |
| 3,350,822 | 11/1967 | Nachazel | 52/170 |

*Primary Examiner*—Andrew V. Kundrat
*Assistant Examiner*—Andrew M. Falik
*Attorney, Agent, or Firm*—Cushman, Darby & Cushman

[57] ABSTRACT

The invention relates to a device for driving root supports of poles into the ground by a weight that is guided by a guide. The weight is lifted up by a rope that passes over a pulley on the guide. The lower portion of the guide is provided with an installation device that grasps an edge of the root support, and the lifting rope is arranged as passing over the pulley so as to leave the pulley in the direction towards the pole.

2 Claims, 3 Drawing Figures

DEVICE FOR DRIVING ROOT SUPPORTS OF POLES INTO THE GROUND

Figure 1:
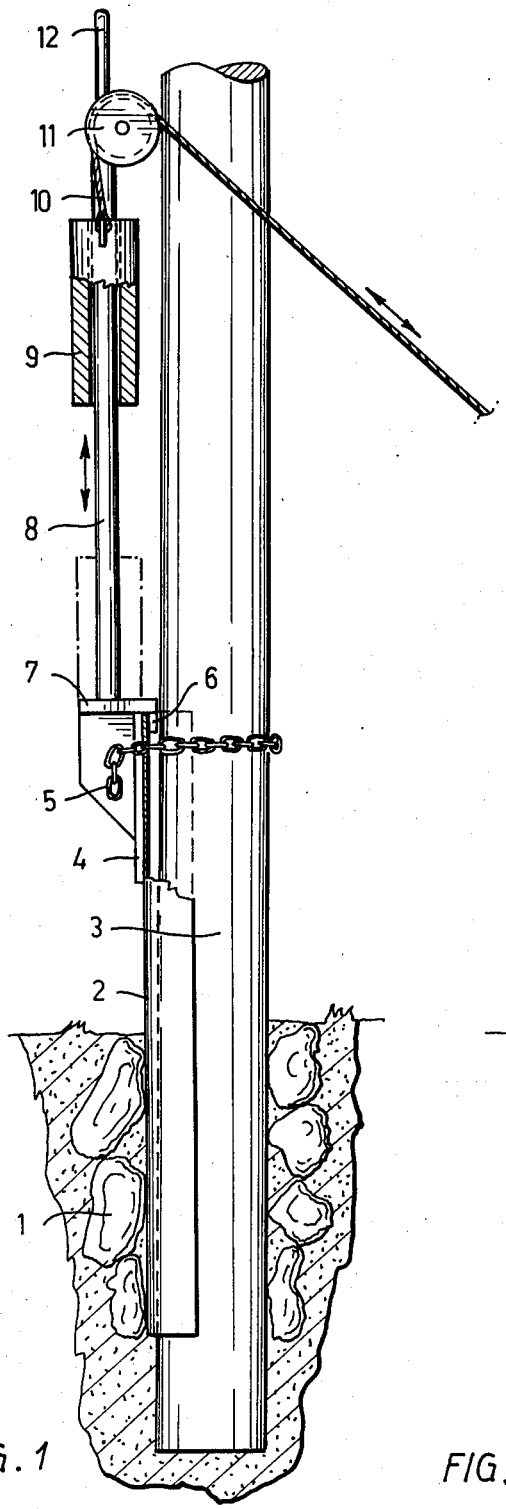

The present invention is concerned with a device for driving root supports of poles into the ground, said device comprising a weight producing the impact force, a guide for guiding the movements of the weight, and means for producing movement of the weight back and forth, said means comprising at least one pulley fastened to the guide and a rope or the like passing over the pulley and, at one end, fastened to the weight, the lower portion of the guide being provided with means for detachable mounting of the device onto the root support.

In all countries in which, after the Second World War, unimpregnated or poorly impregnated wooden poles have been mounted, some of the poles have become rotten at the ground level necessistating that they be replaced or provided with reinforcing pole root supports reinforcing the rotten base of the pole.

The replacement of individual poles with interruptions in the power supply and with necessarily involved labor, machine, and material expenses is so expensive for the electricity and telephone companies that they attempt to support rotten poles until it is justified to reconstruct the entire power or telephone line.

Similar root supports have been driven into the ground in the past mainly by two different methods.

In U.S. Pat. No. 3,033,297 a device used for this purpose is described, consisting of a U-section guide supported against the ground. Inside the guide there is mounted a device operated by a hydraulic motor for moving a weight vertically inside the guide. The guide also surrounds the root support placed underneath the weight. Drawbacks of similar devices are their high weight, complicated structure, and difficulty of installation. Since the position of the root support in relation to the pole is precisely determined, the position of the guide in relation to the pole must also be correct in order that the weight should meet the root support in the desired way. The ground around poles is, however, often covered with stones and uneven, for which reason installation of a heavy guide in the desired position along the pole is cumbersome, and mostly it is necessary to use cranes for that purpose, as is also suggested in said U.S. Patent.

Another method is suggested in U.S. Pat. No. 3,320,714. In that method an air hammer is mounted on special ladders leaning against the pole and provided with pulleys and, moreover, the hammer is fastened to the pole by means of chains surrounding the pole. As the pole reinforcement is being forced into the ground, the position and location of the air hammer must be constantly adjusted by means of ropes in order that the hammer should all the time have full effect on the root support in the correct direction. This adjustment requires both complicated equipment and trained personnel.

It is a common feature of the devices described above that they are difficult to carry in rough terrain, and in farming areas they damage the crops and result in high indemnities.

German Pat. No. 731,841 describes a device for driving a pole, rather than a rest support into the ground. In this device a disk or anvil is fastened to the plane top face of the pole, and a guide is secured to a hole in the anvil disk for the weight. The weight is lifted up by means of ropes passing over symmetrically placed pulleys.

The object of the present invention is to eliminate the above drawbacks by means of an inexpensive and easy-to-carry device which causes a minimum of damage to land owners and which can be handled and operated even by one man.

This object is achieved by mounting means which comprises a connecting part and two parallel projections placed on one side of this connecting part, the distance between said projections being approximately equal to the thickness of the reinforcing root support and said projections being positioned so that, when the device is installed, they are placed on different sides of the root support so as to secure the guide in a position substantially parallel to the root support and that each rope for lifting the weight has been arranged as running over a pulley so that it leaves the pulley in the direction of the pole. Owing to the arrangement in accordance with the invention, the guide keeps itself constantly in the correct position in relation to the root support thereby optimizing the impact effect of the weight. This effect is produced, on one hand, by the construction of the mounting means and, on the other hand, by the circumstance that each lifting rope leaves the pulley in the direction of the pole. Moreover, the guide and the weight follow the root support, without any particular operations, when the support penetrates into the ground. Since the device in accordance with the invention does not require components by means of which it were supported against the ground or from which it would be hanging above the root support, it can be made very simple and of a very light weight and, consequently, also inexpensive and easy to carry. The preparatory work and the work proper do not require trained personnel.

Since, when the weight is being lifted, the pulling strain on the ropes is directed at the pole, the upper portion of the device does not have to be fastened to the pole, whereby only one fastening to the pole at the installation means placed at a low level is sufficient.

Figure 2:
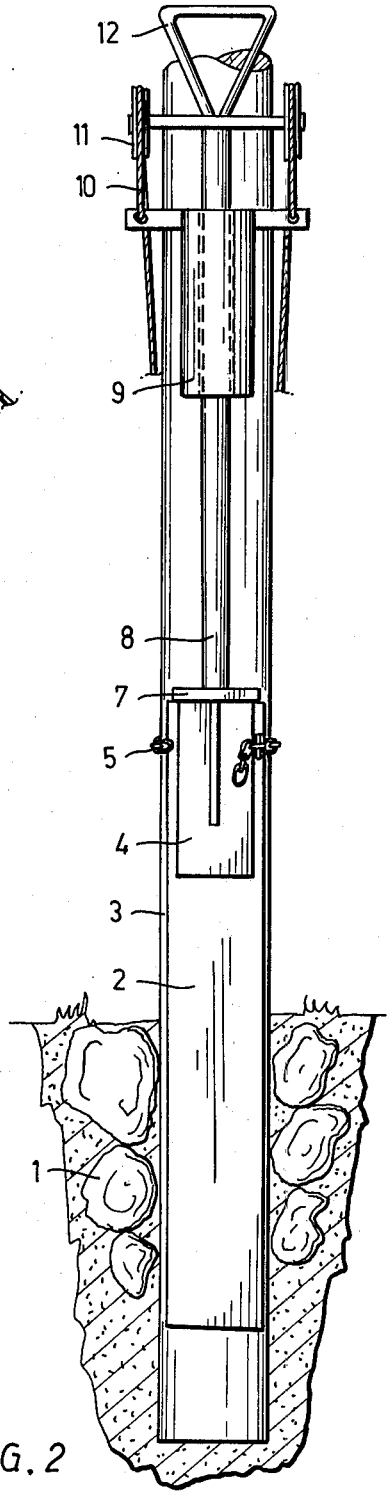
Figure 3:
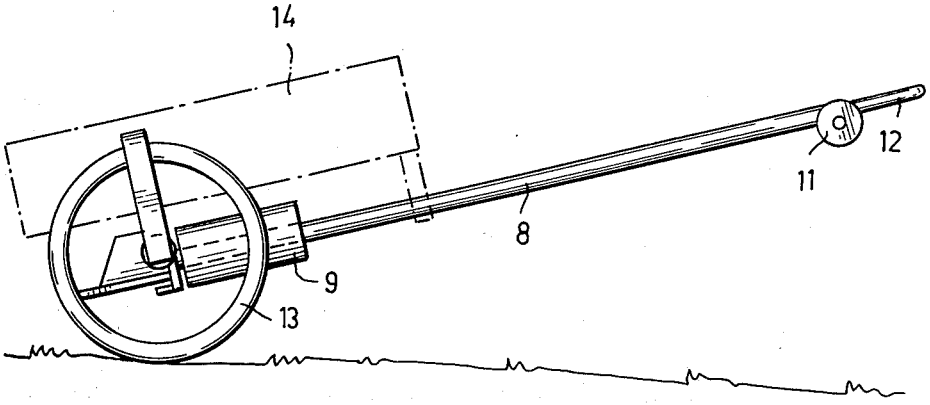

The device in accordance with the present invention will be described more closely below with reference to the attached drawing, wherein FIG. 1 shows the device in accordance with the invention as a side view as mounted in position, FIG. 2 shows the device as viewed from the front, and FIG. 3 shows the device in the transport position.

FIGS. 1 and 2 shows a pole 3 decaying at the ground level, which pole is, in the ground, surrounded by stones 1. In order to support the pole, the pole is surrounded at the rotten position by at least one root support 2, which is, e.g., a semicircular trough bent out of a metal sheet of 2 to 6 mm of thickness, the bending radius of said trough being approximately equal to the radius of the base of the pole. The length of a root support is, e.g., 1.2 to 1.8 meters, about one half of which remains above the ground level.

The device in accordance with the invention comprises a guide 8, which is a, e.g., circular or angular rod, and a weight 9, which surrounds the guide and is coaxial with same and which weight may move along the guide back and forth. In order to produce the movements of the weight, two ropes 10 have been fastened to its fastening brackets, which ropes pass over pulleys 11 fastened to the upper portion of the guide and which ropes extend down to the drive means or to the person performing the work. The term "rope" is intended to include any form of rope or cable. In view of simple installation of the device, it is essential that the ropes shall pass from the pulleys to the opposite side of the poles, because the force effective in the ropes during the lifting of the weight then pulls the guide towards the pole, because of which the guide does not have to be fastened to the pole at the upper end of the guide.

The lower end of the guide is provided with mounting means for detachable installation of the guide onto the root support. The mounting means includes, in the embodiment shown, a connecting part 7 functioning as the anvil and consisting of a substantially horizontal disk or plate, and of parallel projections 4 and 6 fastened to the bottom face of the connecting part, whose distance from each other approximately equals the thickness of the root support. The mounting means is placed at the top edge of the root support 2 so that the root support penetrates in between the projections 4, 6 and its upper edge rests against the connecting part 7. The projections secure the guide in a certain position in relation to the root support, preferably as parallel to same.

The position of the projection 6 between the pole and the root support is in the respect important that it keeps the upper part of the root support at a distance from the pole, the bottom edge of the root support being guided towards the pole 3 and being thereby prevented from striking against stones 1 supporting the pole.

Moreover, the mounting means is made such that it is supported against vertical edges of the root support or against recesses, projections or equivalent placed in the root support, so as to secure the device in position in the lateral direction of the root support.

A fastening means 5 of adjustable length, such as a chain, is fastened to the projection 4, said chain being placed around the pole so as to prevent the top portion of the root support 2 and the device in accordance with the invention from escaping from the pole. The chain may be provided with wheels, in which case it glides smoothly down the pole when the root support is being driven into the ground.

In view of movement on the road and in the terrain, the device may be provided with one or more wheels 13, as shown in FIG. 3, which wheels may preferably be instantly detachable.

One or several frames or platforms 14 may be fastened to the installation means, to the guide 8, or to the wheels 13 for carriage and storage of root supports 2 and/or tools, etc. required at work.

The mounting means and/or the guide of the device may be additionally provided with a means 12 that can be fastened to the hook of a vehicle and/or used for pulling the device in the terrain.

The device in accordance with the invention operates as follows:

The device equipped as shown in FIG. 3 is pushed alongside the pole 3, a root support 2 is placed standing against the pole, and the device is lifted into its working position onto the root support 2, possibly by means of a conventional installation means. When the fastening means 5 has been secured, the weight 9 is lifted to its upper position by pulling on the rope 10 and it is thereupon allowed to fall freely, whereby, when it hits against the anvil 7, it drives the root support into the ground.

This is continued until about one half of the root support has been driven into the ground, whereupon the fastening means 5 is detached and the device is lifted off the root support.

The drawing and the related specification are only intended to illustrate the idea of the invention. Thus, the number of the pulleys 11 placed at the top of the guide may vary from one to several and, if the weight 9 is particularly heavy, the pulleys may be replaced, e.g., by means of a winch in order to increase the transmission ratio.

In stead of fastening to the upper edge of the root support 2, the mounting means may be fastened to the root support at a lower position by means of notches, openings, projections or equivalent provided in the root support, in which case, when being installed, the device does not have to be raised equally high as in the embodiment in which the mounting means is placed at the top edge of the root support. In this case, the guide may be placed either so that the weight hits straight against the top of the root support without the intermediate of the anvil or so that the weight falls beyond the top of the root support against the connecting part 7, whereby the impact force can be transmitted to the root support by means of the connecting part, of the guide, and/or by means of a separate pulling rod. The guide may, of course, consist of several rods or equivalent.

In order to facilitate the installation work, the weight 9 is preferably detachable from the guide, in which case the weight 9 can be lifted into its position separately, which is advantageous especially when the entire installation work is performed by one person.

What I claim is:

1. A device for driving root supports of poles into the ground, said device comprising a weight producing the impact force, a guide for guiding the movements of the weight, and means for producing movement of the weight back and forth, said means comprising at least one pulley fastened to the guide and a rope passing over the pulley and, at one end, fastened to the weight, the lower portion of the guide being provided with means for detachable mounting of the device onto the root support characterized in that the mounting means comprise a connecting part and two parallel projections placed on one side of this connecting part, the distance between said projections being approximately equal to the thickness of the reinforcing root support and said projections being positioned so that, when the device is mounted on the root support, said projections are placed on different sides of the root support so as to secure the guide in a position substantially parallel to the root support and that the rope for lifting the weight has been arranged as running over the pulley so that the rope leaves the pulley in the direction of the pole.

2. A device as in claim 1 in combination with a root support having an upper edge disposed in the space between said projections.

* * * * *